US011786101B2

(12) United States Patent
Kara et al.

(10) Patent No.: US 11,786,101 B2
(45) Date of Patent: Oct. 17, 2023

(54) DISHWASHER, IN PARTICULAR DOMESTIC DISHWASHER

(71) Applicant: Miele & Cie. KG, Guetersloh (DE)

(72) Inventors: Seyfettin Kara, Spenge (DE); Eckard Riedenklau, Bielefeld (DE)

(73) Assignee: MIELE & CIE. KG, Guetersloh (DE)

( * ) Notice: Subject to any disclaimer, the term of this patent is extended or adjusted under 35 U.S.C. 154(b) by 234 days.

(21) Appl. No.: 17/420,684

(22) PCT Filed: Jan. 6, 2020

(86) PCT No.: PCT/EP2020/050116
§ 371 (c)(1),
(2) Date: Jul. 5, 2021

(87) PCT Pub. No.: WO2020/144127
PCT Pub. Date: Jul. 16, 2020

(65) Prior Publication Data

US 2022/0095882 A1 Mar. 31, 2022

(30) Foreign Application Priority Data

Jan. 7, 2019 (DE) ..... 10 2019 100 181.1

(51) Int. Cl.
*A47L 15/12* (2006.01)
*A47L 15/44* (2006.01)
*A47L 15/42* (2006.01)

(52) U.S. Cl.
CPC ..... *A47L 15/4295* (2013.01); *A47L 15/4257* (2013.01); *A47L 15/4409* (2013.01); *A47L 2401/04* (2013.01)

(58) Field of Classification Search
None
See application file for complete search history.

(56) References Cited

U.S. PATENT DOCUMENTS

| | | | |
|---|---|---|---|
| 10,080,477 | B2 | 9/2018 | Fauth et al. |
| 10,898,055 | B2 | 1/2021 | Wöbkemeier |
| 2011/0268311 | A1 | 11/2011 | Hudnut et al. |
| 2012/0125384 | A1 | 5/2012 | Beshears, Jr. et al. |
| 2020/0063323 | A1 | 2/2020 | Kessel et al. |

FOREIGN PATENT DOCUMENTS

| | | | |
|---|---|---|---|
| DE | 10048081 | A1 | 4/2002 |
| DE | 102009023252 | A1 | 12/2010 |
| DE | 102014220245 | A1 | 4/2016 |
| DE | 102015102694 | A1 | 8/2016 |
| DE | 102016106430 | A1 | 11/2016 |
| DE | 102016225854 | A1 | 6/2018 |
| DE | 102017207649 | A1 | 11/2018 |
| EP | 3205764 | A1 | 8/2017 |
| KR | 20060100620 | A | 9/2006 |
| WO | 2012010330 | A1 | 1/2012 |
| WO | 2017032629 | A1 | 3/2017 |

*Primary Examiner* — Levon J Shahinian
(74) *Attorney, Agent, or Firm* — LEYDIG, VOIT & MAYER, LTD.

(57) ABSTRACT

A dishwasher includes: a washing container having a washing compartment and a loading opening for loading items to be washed; a washing compartment door by which the loading opening is closeable in a fluid-tight manner; and a camera unit for visually sensing the washing compartment. The camera unit is integrated into a dispenser provided by the washing compartment door.

19 Claims, 7 Drawing Sheets

DISHWASHER, IN PARTICULAR DOMESTIC DISHWASHER

CROSS-REFERENCE TO PRIOR APPLICATIONS

This application is a U.S. National Phase application under 35 U.S.C. § 371 of International Application No. PCT/EP2020/050116, filed on Jan. 6, 2020, and claims benefit to German Patent Application No. DE 10 2019 100 181.1, filed on Jan. 7, 2019. The International Application was published in German on Jul. 16, 2020 as WO 2020/144127 under PCT Article 21(2).

FIELD

The invention relates to a dishwasher, in particular a domestic dishwasher, having: a washing container which provides a washing compartment and has a loading opening for loading items to be washed; a washing compartment door by means of which the loading opening can be closed in a fluid-tight manner; and a camera unit for visually sensing the washing compartment.

BACKGROUND

Dishwashers of the generic type are well known from the prior art, for example from EP 3 205 764 A1, which discloses a dishwasher with two cleaning cameras arranged in the washing compartment. The cleaning cameras are used to detect dirt.

Furthermore, a dishwasher of the generic type is known from WO 2017/032629 A1. The camera unit accommodated by the washing container in this previously known design is used for load detection.

It is common to the previously known designs that the implementation on the manufacturer side is complex. This is because, for intended use of the camera unit, a fluid-tight design is required, both of the camera unit itself and of its arrangement in a corresponding aperture in a wall of the washing container. In this case, the formation of such an aperture also has the disadvantage that this container wall is weakened, which necessitates design countermeasures. As a result, previously known designs are therefore complex and thus expensive. Moreover, there is the fundamental problem of undesired leakage of the washing container.

SUMMARY

In an embodiment, the present invention provides a dishwasher, comprising: a washing container comprising a washing compartment and a loading opening for loading items to be washed; a washing compartment door by which the loading opening is closeable in a fluid-tight manner; and a camera unit configured to visually sense the washing compartment, wherein the camera unit is integrated into a dispenser provided by the washing compartment door.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
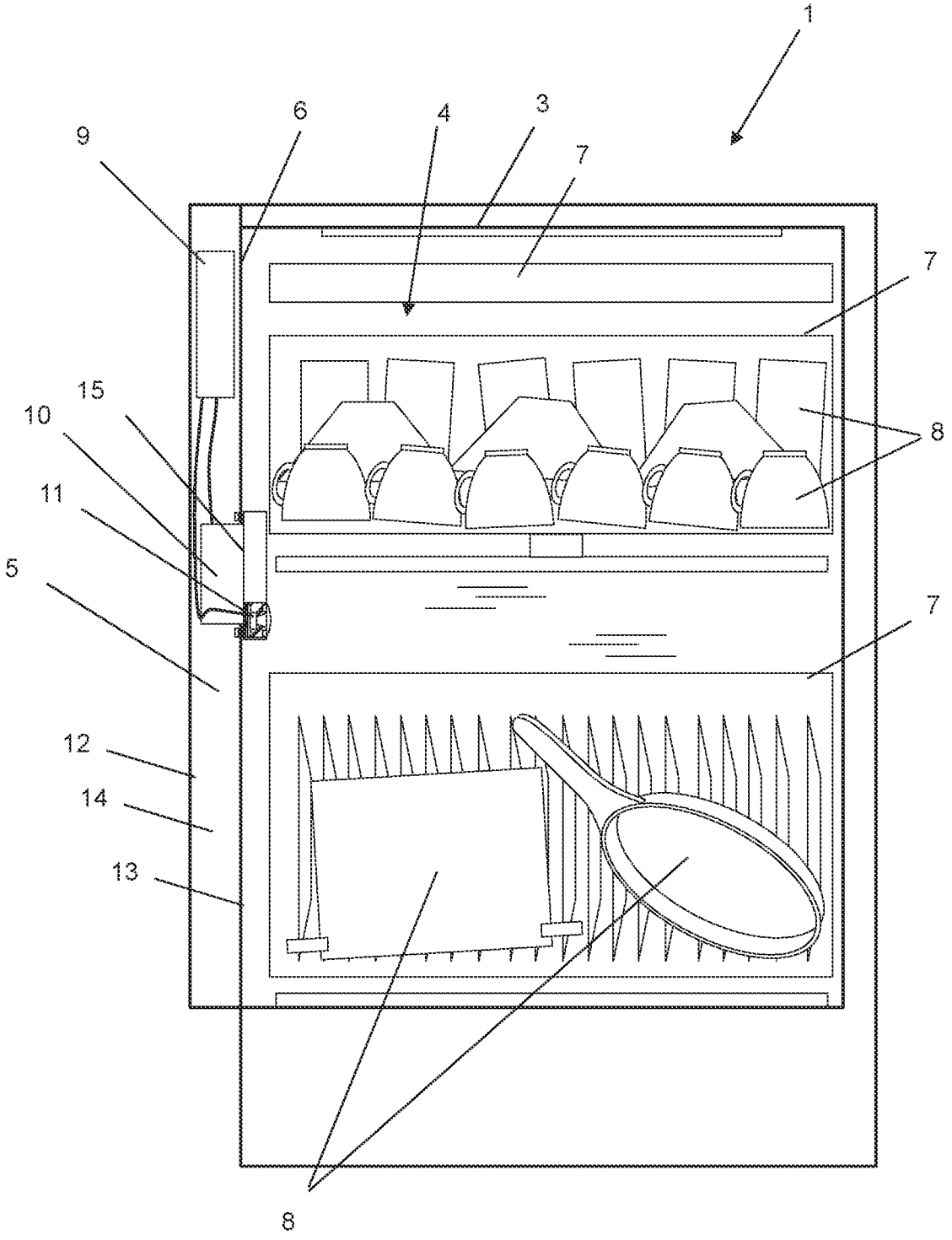
FIG. 1 shows a dishwasher according to the invention in a schematic sectional diagram from the side.

In an embodiment, the present invention provides a dishwasher such that a generally simplified design with regard to the arrangement of the camera unit for visually sensing the washing compartment is made possible while ensuring the desired tightness of the washing container.

In an embodiment, the present invention provides a dishwasher of the type mentioned initially, characterized in that the camera unit is integrated into a dispenser provided by the washing compartment door.

A dispenser is a device which is provided anyway by a dishwasher of the generic type and, when used as intended, is used for dispensing process chemicals into the washing compartment. The dispenser is provided by the washing compartment door and is accessible to the user when the washing compartment door is open. Typically, a dispenser has a storage chamber, which can be closed by means of a flap, for receiving cleaning agent. Before the start of a washing program, the user can fill this storage chamber with cleaning agent and can close it by means of the flap. During a washing program, the flap opens so that the cleaning agent located in the storage chamber is washed out and added to the circulated washing liquor.

With the design according to the invention, it is now provided that, in departure from the prior art, the camera unit is arranged not in an aperture provided by a wall of the washing compartment but rather on the washing compartment door, specifically integrated into the dispenser provided by the washing compartment door.

A washing compartment door of dishwashers of the generic type has an outer panel on one side and an inner panel on the other side, these two panels being spaced from each other to form a cavity. In order to arrange the dispenser on the washing compartment door, the inner door panel is provided with an aperture into which the dispenser is inserted so as to protrude into the cavity provided by the washing compartment door. In order to seal the aperture, a seal is typically provided between the dispenser on one side and the outer surface of the inner door panel on the washing compartment side.

The design according to the invention provides essentially two advantages. On the one hand, there is no need for the separate formation of an aperture for accommodating the camera unit in a wall of the washing container. This is because the integration according to the invention of the camera unit into the dispenser makes use of the aperture already provided for the dispenser without in the inner door panel. In this respect, it is possible to dispense with the additional formation of an aperture, which in this respect simplifies production but also avoids undesired component weakening.

On the other hand, the sealing problems are eliminated. The dispenser is already inserted anyway in a fluid-tight manner into the aperture provided for this purpose in the inner door panel. There is therefore no need for a seal provided according to the prior art between a camera unit and an aperture provided for this purpose in a wall of the washing container. This also results in simplified production, in particular simplified assembly, and at the same time eliminates a potential leak point.

As a result, the design according to the invention provides a generally simplified design while ensuring the desired tightness and stability.

According to a further feature of the invention, the camera unit has a camera and an optical system interacting therewith. The camera can be in the form of a camera chip, for example. The optical system of the camera unit is used in particular to achieve an optimized design for the visual sensing of the washing compartment. In particular, it is desirable to allow image capture which is as sharp as possible even over the depth of the washing compartment.

According to a further feature of the invention, the camera unit has lighting means, for example in the form of LEDs. When used as intended, the lighting means are used to illuminate the washing compartment, which improves visual sensing thereof. According to this preferred embodiment of the invention, lighting means to be arranged separately in the washing compartment can be dispensed with.

According to a further feature of the invention, the camera unit has a fluid-tight housing with a camera opening. The camera, the optical system and the lighting means which may be present are arranged within the housing. In this preferred embodiment of the invention, the camera unit is designed as an overall compact component. It can be produced in a prefabricated manner, which simplifies assembly and integration into the dispenser. When used as intended, the camera captures images through the camera opening provided by the housing.

The camera unit has, according to a further feature of the invention, a cover which closes the camera opening in a fluid-tight manner. The housing of the camera unit as such is fluid-tight except for the camera opening provided thereby. The cover is used to close the camera opening in a fluid-tight manner. Alternatively, it may also be provided for the optical system provided by the housing to be inserted into the camera opening in a fluid-tight manner. In this case, no separate fluid-tight cover of the camera opening is required. However, it is also an advantage of the cover that there is some protection against mechanical stresses for the camera, the optical system and the lighting means which may be provided, which is why the use of a cover which closes the camera opening in a fluid-tight manner is preferred. Of course, a combination of an optical system inserted into the camera opening in a fluid-tight manner and a cover additionally closing the camera opening in a fluid-tight manner is also conceivable.

According to a further feature of the invention, the camera unit is inserted in a fluid-tight manner into a recess provided by the dispenser. The fluid-tight arrangement of the camera unit in the recess of the dispenser provided for this purpose can be achieved in a simple manner in that the housing of the camera unit is glued and/or welded and/or otherwise integrally or virtually integrally bonded to the dispenser.

According to a preferred embodiment of the invention, the housing of the camera unit is formed in that the remaining components of the camera unit, such as the camera, the optical system and the lighting means which may be provided, are overmolded with plastic. This results in an intimate connection between the plastic material forming the housing and the further components of the camera unit embedded therein. The camera unit thus formed can then be glued, for example, into the recess of the dispenser provided for this purpose. The recess of the dispenser is fluid-tight except for the insertion opening for the camera unit and an opening which may be provided for feeding through a connecting cable for the camera unit.

According to a further feature of the invention, connecting cables for the camera unit are laid in a cavity formed between an outer door panel and an inner door panel of the washing compartment door. In this respect, an additional sealing with regard to the connecting cable is advantageously not required, which likewise contributes to the simplicity of the design according to the invention.

According to a further feature of the invention, a closure element is provided. This closure element can be transferred from a closed position covering the camera opening into a use position exposing the camera opening and vice versa.

The closure element provides essentially two advantages. When the washing compartment door is closed, the closure element is in the use position in which the camera opening is exposed. When used as intended, the camera unit can visually sense the washing compartment interior when the closure element is in this position. When the washing compartment door is open, i.e., when the dishwasher can be loaded by a user, the closure element is in its closed position, in which the camera opening is covered. The covering of the camera opening in the closed position ensures that clogging of the camera opening and/or soiling of a cover of the camera opening by food residues, impurities and/or other solids or liquids falling and/or flowing when the washing compartment is filled with items to be washed is reliably avoided. In addition, mechanical safety for the camera unit against falling items to be washed is provided in the closed position of the closure element.

The closure element has a further advantage. Image capture by the camera unit when the washing compartment door is open is ruled out when the closure element is in the closed position. Thus, neither the surroundings of the dishwasher nor a user of the dishwasher can be sensed by the camera unit, which is advantageous in particular for data or data protection reasons.

The closure element according to the invention therefore allows an intended image capture of only the washing compartment to take place. In addition, protection against soiling and protection against mechanical stress caused by inadvertently falling items to be washed are provided with respect to the camera unit.

According to a further feature of the invention, the closure element is a flap which is arranged displaceably on the dispenser. This flap can, for example, be manually operated and brought from the closed position into the use position and vice versa by the user. Manual actuation of the closure element by the user has the advantage that the user can actively and thus consciously ensure that image capture by the camera unit is reliably ruled out when the washing compartment door is in an open position.

According to a further feature of the invention, the closure element is a flap provided by the dispenser for selectively closing a dispensing chamber provided by the dispenser. According to this embodiment, no separate flap is provided for closing the camera opening. Rather, the flap provided anyway by the dispenser for closing the dispensing chamber is used as the closure element.

According to a further feature of the invention, the invention is characterized by means which cause the closure element to be transferred from the closed position into the use position and vice versa depending on the position of the washing compartment door. A manual intervention for transferring the closure element from one position into the other position or vice versa is not required in this embodiment. Rather, the closure element is moved automatically, specifically depending on the position of the washing compartment door, which is effected according to the invention by means provided correspondingly for this purpose. These means can be, for example, a cable pull arrangement which acts on the closure element depending on the opening angle of the washing compartment door. Alternatively, a lever arrangement with a counterweight can also be provided, which causes a displacement movement of the closure element due to gravity when the washing compartment door is pivoted.

In this connection, the invention also and in an independently patentable manner proposes a method for operating a dishwasher of the type according to the invention and described above, in which the closure element is transferred out of the closed position into the use position and vice versa depending on the position of the washing compartment door. The advantages resulting from carrying out such a method correspond to the advantages already explained above.

FIG. 1 shows a dishwasher 1 according to the invention in a purely schematic, partially cut-away side view.

The dishwasher 1 has a housing 2 which accommodates, inter alia, a washing container 3. The washing container 3 in turn provides a washing compartment 4 which, when used as intended, is used to accommodate items 8 to be washed.

In the exemplary embodiment shown, item carriers 7, specifically in the form of washing racks, are used to accommodate the items 8 to be washed, wherein a lower rack, an upper rack and a cutlery drawer are provided.

Figure 13:
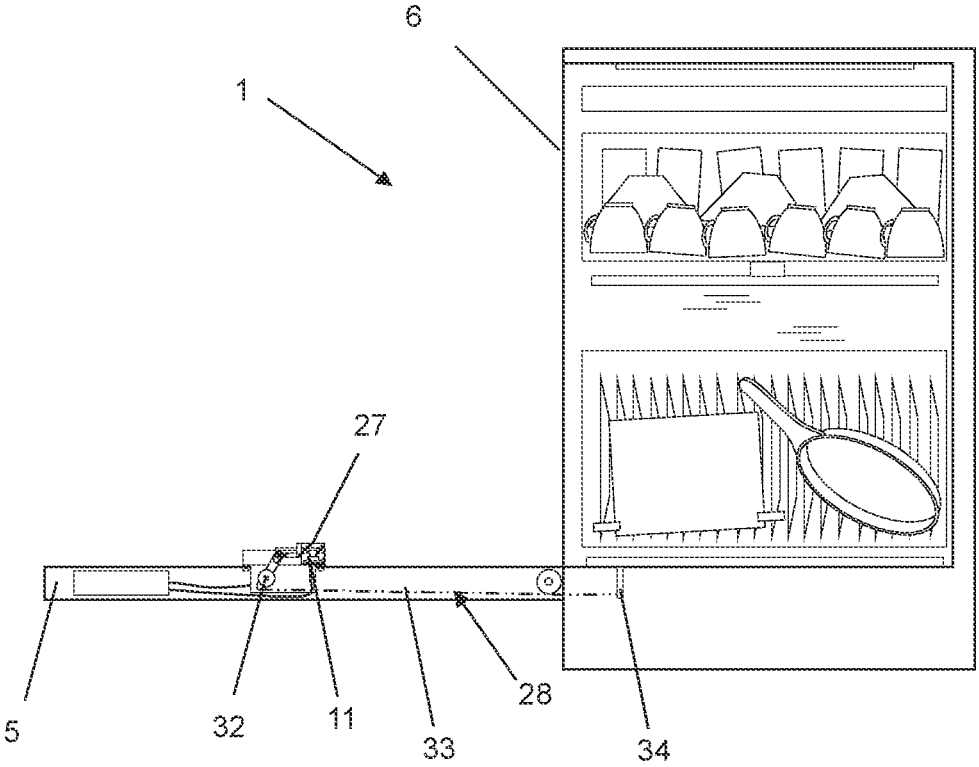
FIG. 13 shows the embodiment according to FIG. 12, with a washing compartment door in the open position.

The washing compartment 4 is accessible to the user through the loading opening 6. The loading opening 6 can be closed in a fluid-tight manner by means of a washing compartment door 5, wherein the washing compartment door 5 can be pivoted about a horizontal pivot axis and can be transferred by the user from the closed position shown in FIG. 1 into an open position and vice versa. FIG. 13 shows such an open position of the washing compartment door 5 by way of example.

The washing compartment door 5 has an outer door panel 12 and an inner door panel 13, which are spaced from each other to leave a cavity 14. Further components of the dishwasher, for example an operating and control unit 9, can be arranged within the cavity 14 between the outer door panel 12 and the inner door panel 13.

The washing compartment door 5 furthermore provides a dispenser 10. The latter protrudes at least partially into the cavity 14 provided by the washing compartment door 5. For this purpose, the inner door panel 13 is provided with an aperture in the form of a recess 15 into which the dispenser 10 is inserted in a fluid-tight manner.

The dispenser 10 is a device which, when the dishwasher 1 is used as intended, ensures that process chemicals, such as cleaning agents, are dispensed into the washing compartment 3.

Figure 2:
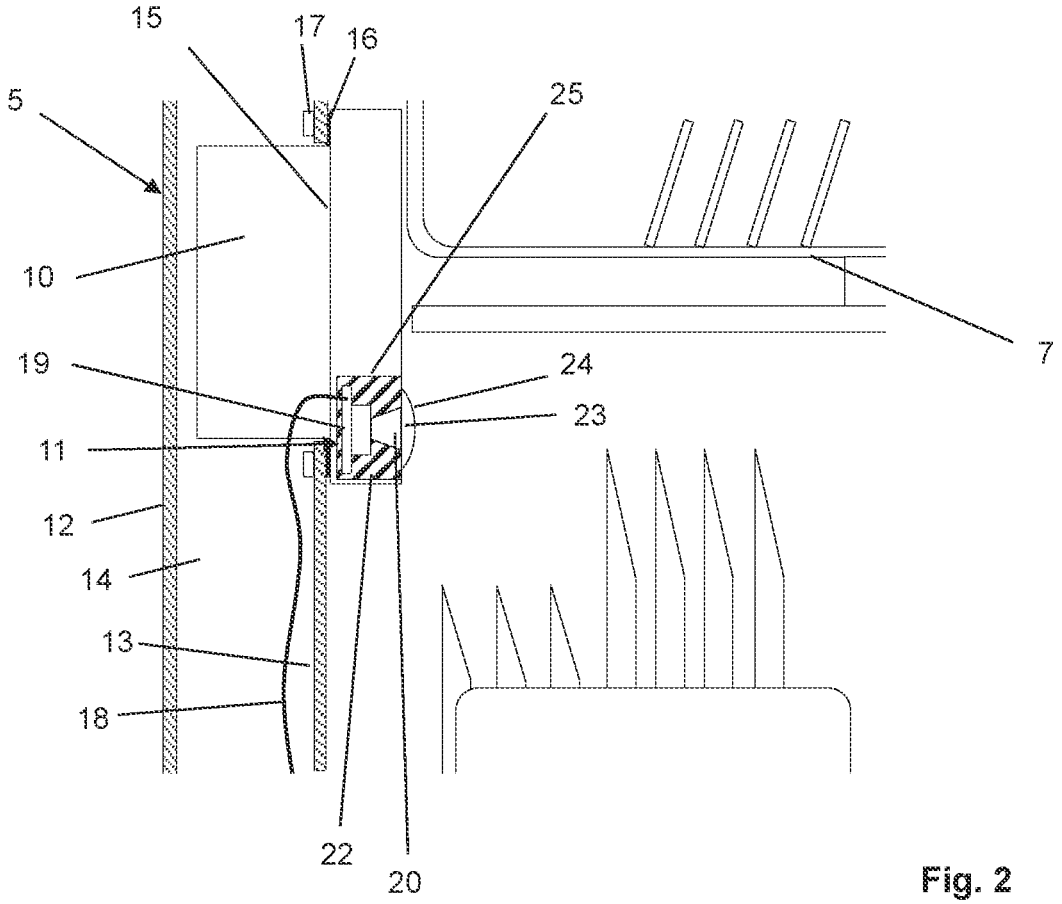
FIG. 2 schematically shows details of a first embodiment of the camera unit according to the invention in a partially cut-away side view.

For fluid-tight insertion of the dispenser 10 into the recess 15, a peripheral seal 16 is used, as is evident in particular from the detail view according to FIG. 2. For securely fixing the dispenser 10 in position in relation to the inner door panel 13, a screw connection 17 is provided in the embodiment shown, by means of which the seal 16 between the inner door panel 13 and the dispenser 10 is also held securely in position.

The dishwasher furthermore has a camera unit 11. When used as intended, said camera unit is used for visually sensing the washing container interior, i.e., the washing compartment 3, as can be seen in particular by the overview according to FIG. 1.

According to the invention, the camera unit 11 is integrated into the dispenser 10 provided by the washing compartment door 5.

As can be seen in particular from the diagram of FIG. 2, the camera unit 11 in the exemplary embodiment shown here has a housing 22, which accommodates a camera 19 and an optical system 20. The housing 22 is provided with a camera opening 23 through which, when used as intended, image capture takes place by means of the camera with interposition of the optical system 20. In order to protect the camera opening 23 and/or the optical system 20 located behind it, the camera opening 23 is equipped with a cover 24. The cover 24 preferably closes the camera opening 23 in a fluid-tight manner.

For the integrated arrangement of the camera unit 11 in the dispenser 10, the dispenser 10 provides a recess 25 into which the camera unit 11 is inserted in a fluid-tight manner. Preferably, the camera unit 11 is glued or welded into the recess 25 of the dispenser 10. For power connection and/or signal connection of the camera unit 11 to an operating and/or control unit 9, connection cabling 18 is provided, which is laid in a fluid-tight manner within the cavity 14 of the washing compartment door 5.

The particular advantage of the design according to the invention is that there is no need for a separate sealing means for a fluid-tight arrangement of the camera unit 11 on the dispenser 10. In departure from the prior art, a separately provided aperture, for example in a wall of the washing container 3, is also not required to accommodate the camera unit 11. The integration according to the invention of the camera unit 11 in the dispenser 10 makes use of the anyway provided fluid-tight arrangement of the dispenser 10 in the recess 15 provided for this purpose in the inner door panel 13 of the washing compartment door 5.

Figure 3:
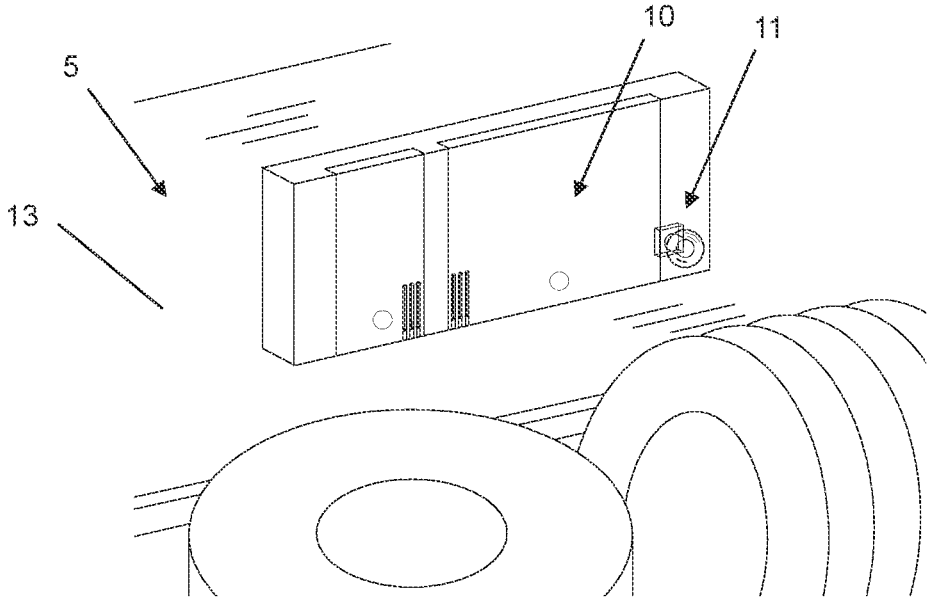
FIG. 3 shows the camera unit according to FIG. 2 in a schematic perspective view.

FIG. 3 shows the embodiment according to FIG. 2 in a schematically perspective view. As can be seen from this diagram, the dispenser 10 provides two dispensing chambers, each of which can be closed by respective flaps. The camera unit 11 is arranged on the right of the dispenser flaps in relation to the drawing plane of FIG. 3.

Figure 4:
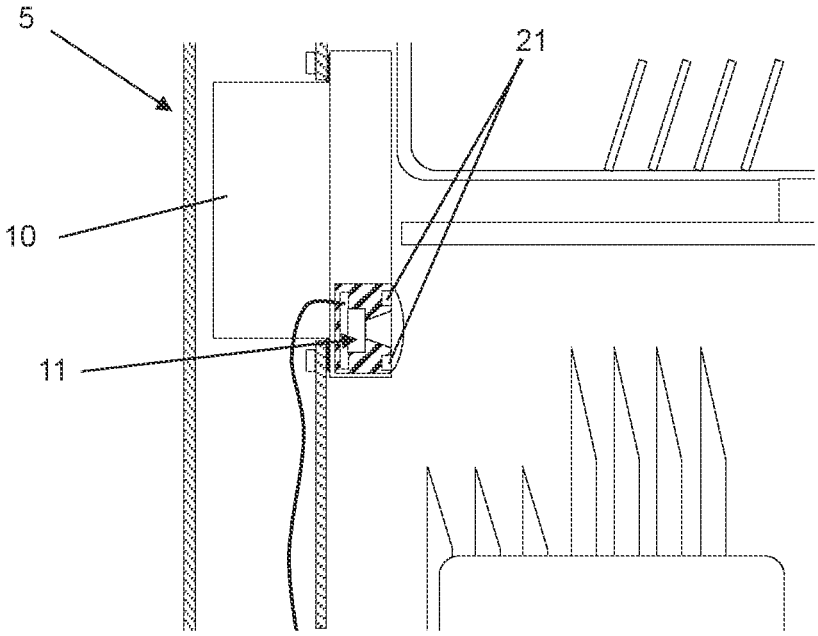
FIG. 4 schematically shows details of a second embodiment of the camera unit according to the invention in a partially cut-away side view.
Figure 5:
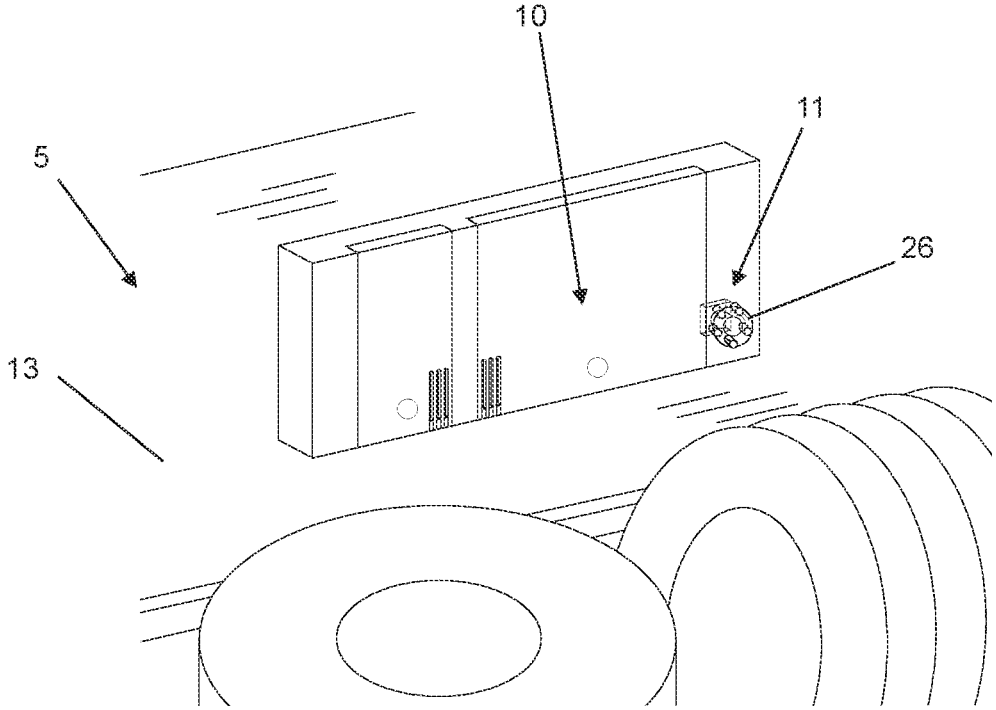
FIG. 5 shows the camera unit according to FIG. 4 in a schematic perspective view.

A second embodiment of the invention is shown in FIGS. 4 and 5. In contrast to the embodiment according to FIGS. 2 and 3, the embodiment according to FIGS. 4 and 5 provides lighting means 21 provided by the camera unit 11.

These lighting means 21 are, for example, LEDs which are accommodated by the housing 22 of the camera unit 11. The LEDs are preferably arranged to form a lighting means ring 26 which, in the finally assembled state, surrounds the optical system 20 and/or the camera opening 23 peripherally, as can be seen in particular in the perspective diagram according to FIG. 5.

Figure 6:
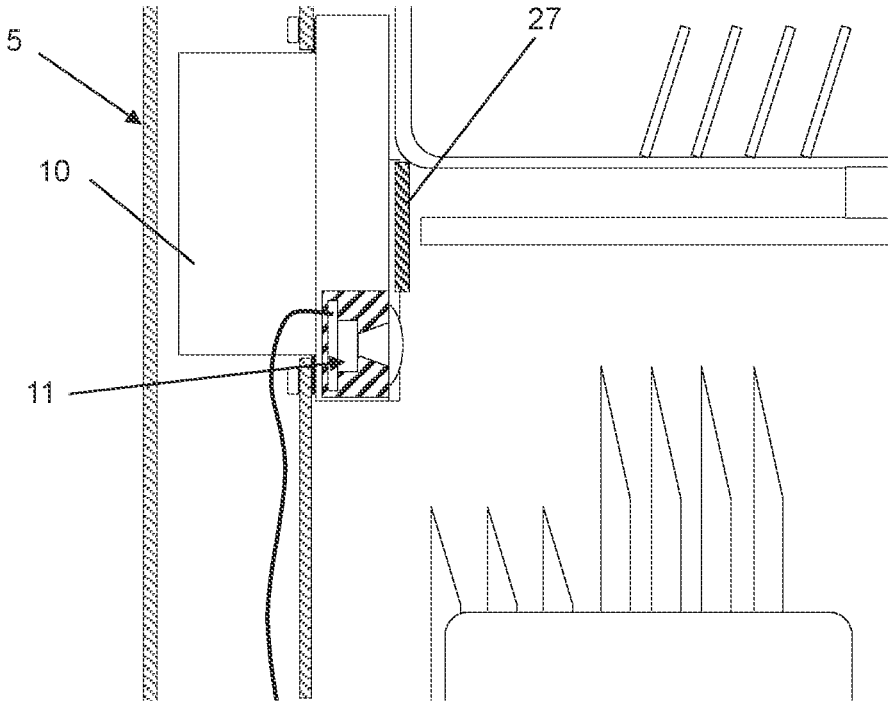
FIG. 6 shows details of a third embodiment of the camera unit according to the invention in a partially cut-away side view, with a closure element in the use position.
Figure 7:
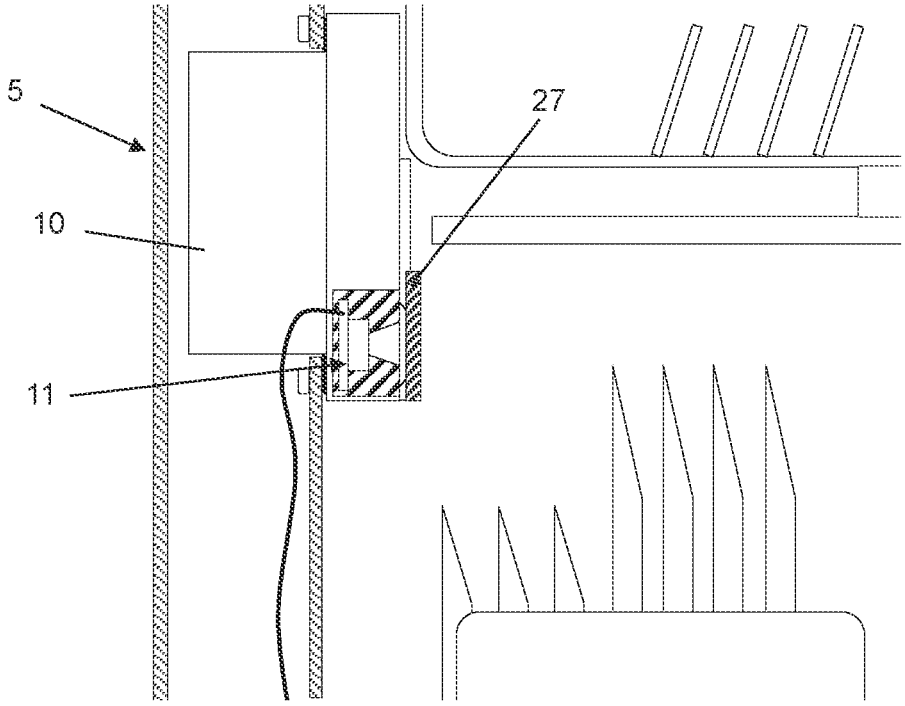
FIG. 7 shows the camera unit according to FIG. 6, with a closure element in the closed position.

A particularly preferred embodiment is shown in FIGS. 6 to 7. According to this embodiment, a closure element 27 is used, which can be transferred from a use position into a closed position and vice versa. The use position of the closure element 27 is shown in FIG. 6, whereas the closed position of the closure element 27 is shown in FIG. 7.

The closure element 27 is used to selectively cover the camera unit 11; in the use position of the closure element 27 according to FIG. 6, the camera unit 11, i.e., the camera opening 23, is uncovered by the closure element 27, which enables the camera unit 11 to be used as intended. In contrast, in the closed position of the closure element 27 in FIG. 7, the camera opening 23 is covered by the closure element 27 so that image capture by the camera unit 11 is prevented.

In the exemplary embodiments according to FIGS. 6 and 7, the closure element 27 can be moved manually by the user; the closure element 27 therefore can be transferred manually from the closed position into the use position and vice versa.

In the closed position, the closure element 27 protects the camera unit 11 from unwanted soiling and/or from possibly falling items to be washed, in particular when the washing compartment door 5 is in its open position, as shown, for example, in FIG. 13. In addition, covering the camera unit 11 in the open position of the washing compartment door 5 is advantageous for data protection reasons since image capture by the camera unit 11 is prevented when the washing compartment door is in the open position.

Figure 8:
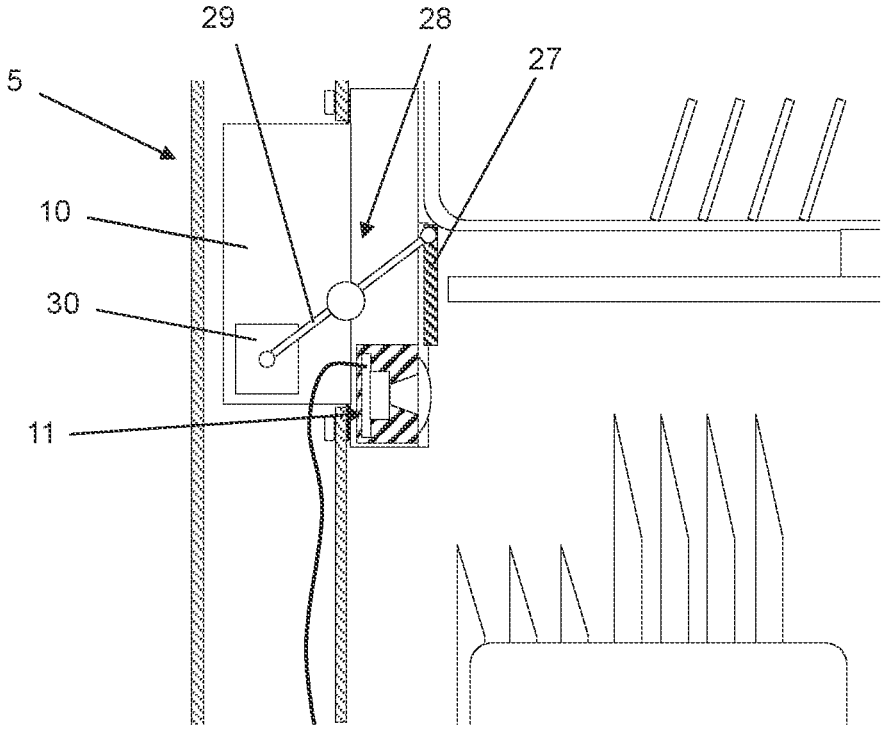
FIG. 8 schematically shows a further embodiment in a partially cut-away side view, with a closure element in the use position.
Figure 9:
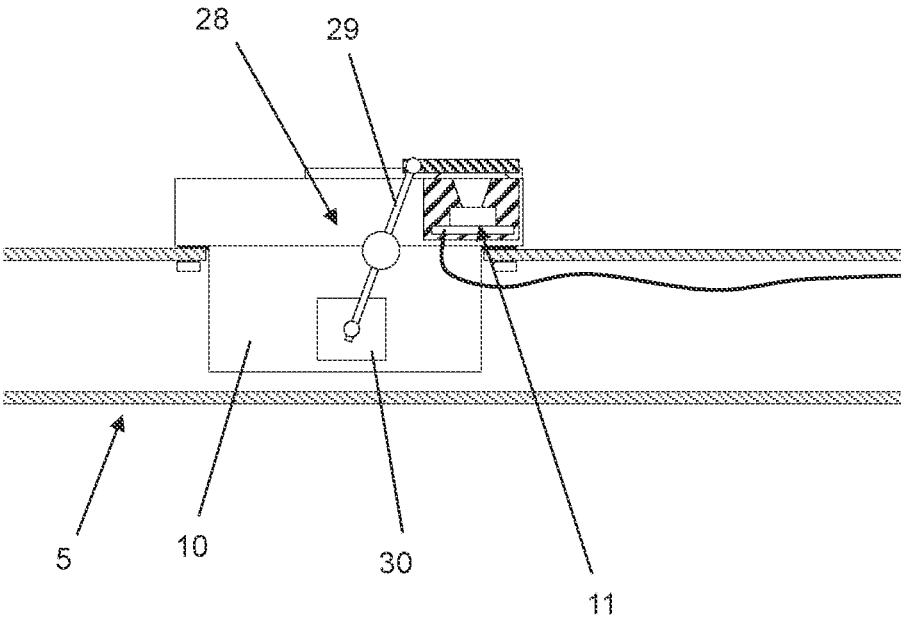
FIG. 9 shows the camera unit according to FIG. 8, with a closure element in the closed position.

FIGS. 8 and 9 show a further exemplary embodiment of the invention. Accordingly, means 28 are provided which cause the closure element 27 to be transferred from the closed position into the use position and vice versa depending on the position of the washing compartment door 5. According to the exemplary embodiment shown, the means 28 has a pivotably mounted pivot lever 29, which interacts with the closure element 27 at one end and with a counterweight 30 at the other end. When the washing compartment door 5 is transferred from the closed position according to FIG. 8 into the open position according to FIG. 9, a change in position of the counterweight 30 occurs due to gravity, as a result of which a pivoting movement of the pivot lever 29 occurs with the result that the closure element 27 arranged on the pivot lever 29 likewise moves in a positively driven manner.

Figure 10:
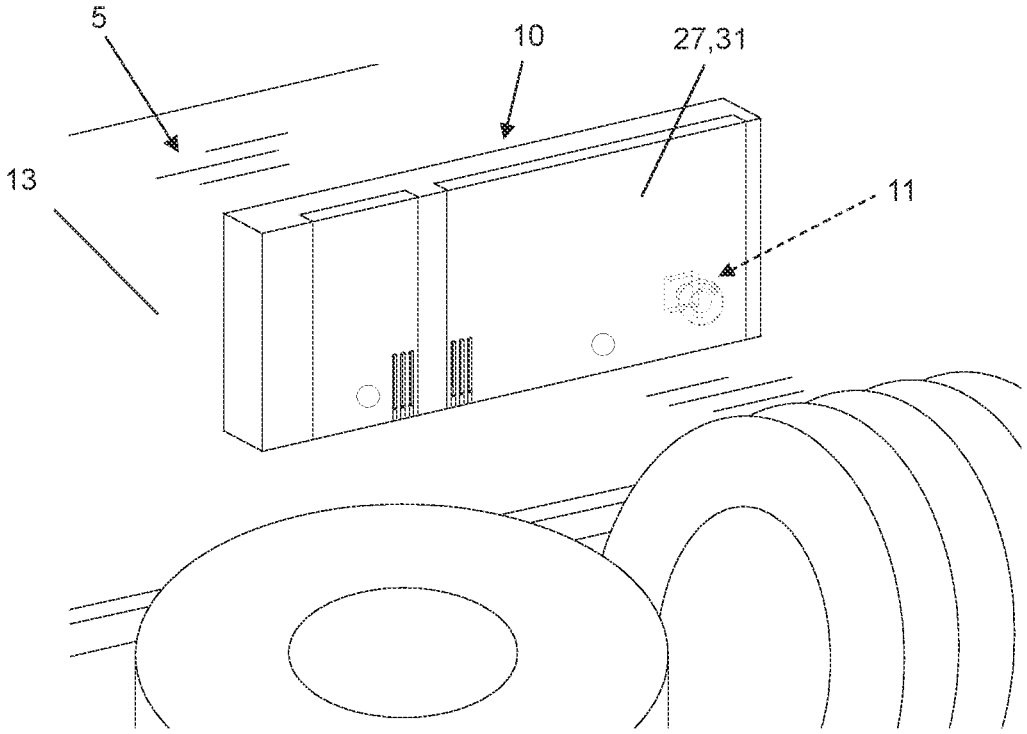
FIG. 10 shows a further embodiment in a schematic perspective diagram, with a closure element in the closed position.
Figure 11:
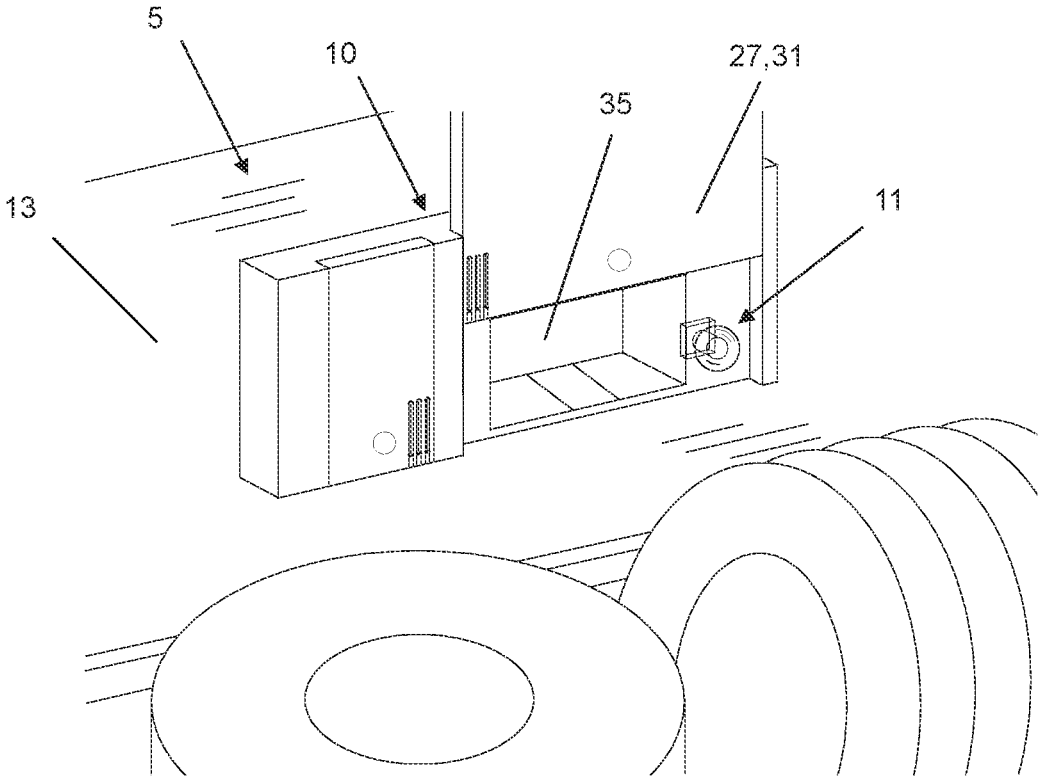
FIG. 11 shows the embodiment according to FIG. 10 with a closure element in the use position.

According to a further embodiment of the invention, which is shown in FIGS. 10 and 11, a flap 31 provided anyway by the dispenser 10 is used as the closure element 27 and is used for closing a dispensing chamber 35 provided by the dispenser 10. A separate closure element 27 is not required in this embodiment since the anyway present closure flap 31 of the dispenser 10 is used as the closure element 27.

Figure 12:
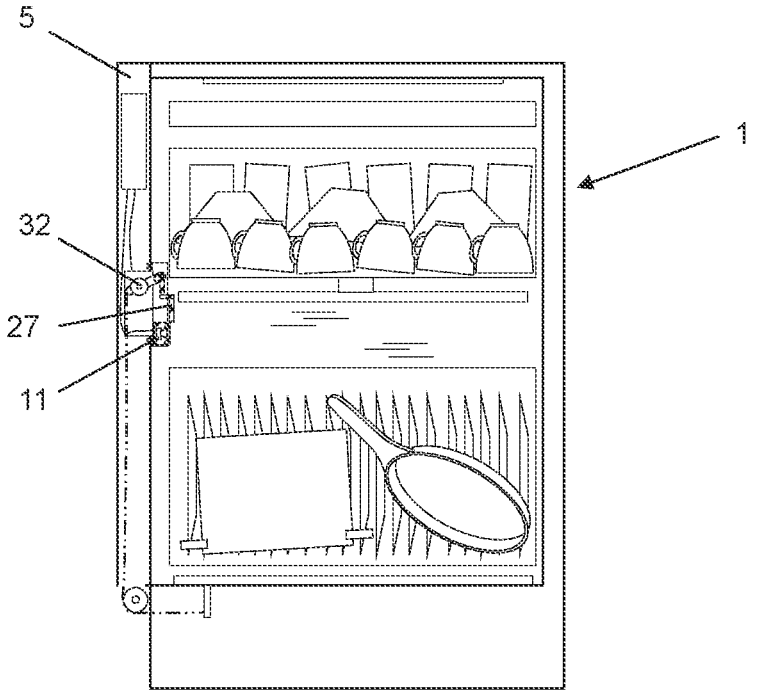
FIG. 12 shows a dishwasher according to the invention in a schematic, partially cut-away side view, with a washing compartment door in the closed position.

A further exemplary embodiment is shown in FIGS. 12 and 13. A means 28 which is used for automatically moving the closure element 27 depending on the position of the washing compartment door 5 is also used in this embodiment. In this exemplary embodiment, the means 28 has a cable pull 33, which interacts with the closure element 27 at one end and is fixed to an abutment 34 at the other end, and a pivot lever 32. When the washing compartment door 5 is pivoted from the open position of the washing compartment door 5 according to FIG. 13 into the closed position of the washing compartment door 5 according to FIG. 12, a force is exerted on the closure element 27 by the cable pull 33 arranged thereon via the pivot lever 32, which causes the closure element 27 to move out of the closed position when the washing compartment door 5 is open into the use position when the washing compartment door 5 is closed.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

| Reference signs | |
|---|---|
| 1 | Dishwasher |
| 2 | Housing |
| 3 | Washing container |
| 4 | Washing compartment |
| 5 | Washing compartment door |
| 6 | Loading opening |
| 7 | Item carrier |
| 8 | Items to be washed |
| 9 | Operating and/or control unit |
| 10 | Dispenser |
| 11 | Camera unit |
| 12 | Outer door panel |
| 13 | Inner door panel |
| 14 | Cavity |
| 15 | Recess |
| 16 | Seal |
| 17 | Screw connection |
| 18 | Connecting cable |
| 19 | Camera (camera chip) |
| 20 | Optical system |
| 21 | Lighting means |
| 22 | Housing |
| 23 | Camera opening |
| 24 | Cover |
| 25 | Recess |
| 26 | Lighting means ring |
| 27 | Closure element |
| 28 | Means |
| 29 | Pivot lever |

-continued

| Reference signs | |
|---|---|
| 30 | Counterweight |
| 31 | Flap |
| 32 | Pivot lever |
| 33 | Cable pull |
| 34 | Abutment |
| 35 | Dispensing chamber |

The invention claimed is:

1. A dishwasher, comprising:

a washing container comprising a washing compartment and a loading opening for loading items to be washed;

a washing compartment door by which the loading opening is closeable in a fluid-tight manner; and a camera unit configured to visually sense the washing compartment, wherein the camera unit is integrated into a dispenser provided by the washing compartment door, and wherein the camera unit has a camera and an optical system interacting therewith, the camera and optical system being configured to allow sharp image capture over a depth of the washing compartment.

2. The dishwasher of claim 1, wherein the camera unit has lighting means.

3. The dishwasher of claim 2, wherein lighting means comprise LEDs.

4. The dishwasher of claim 1, wherein the camera unit has a fluid-tight housing with a camera opening, the housing accommodating the camera, the optical system, and a lighting means.

5. The dishwasher of claim 4, further comprising:

a closure element which is transferrable between a closed position covering the camera opening into a use position exposing the camera opening.

6. The dishwasher of claim 5, wherein the closure element comprises a flap which is arranged displaceably on the dispenser.

7. The dishwasher of claim 5, wherein the closure element comprises a flap provided by the dispenser for selectively closing a dispensing chamber provided by the dispenser or interacting with such a flap.

8. The dishwasher of claim 5, further comprising:

transferring means configured to cause the closure element to be transferred between the closed position and the use position depending on a position of the washing compartment door.

9. The dishwasher of claim 5, wherein the closure element is in the use position when the washing compartment door is closed, and/or wherein the closure element is in the closed position when the washing compartment door is open.

10. The dishwasher of claim 1, wherein the camera unit has a cover configured to close a camera opening in a fluid-tight manner.

11. The dishwasher of claim 1, wherein the camera unit is inserted in a fluid-tight manner into a recess provided by the dispenser.

12. The dishwasher of claim 1, wherein connecting cables for the camera unit are laid in a cavity formed between an outer door panel and an inner door panel of the washing compartment door.

13. A method for operating the dishwasher of claim 1, comprising:

transferring a closure element between a closed position and a use position depending on a position of the washing compartment door.

14. A dishwasher, comprising:

a washing container comprising a washing compartment and a loading opening for loading items to be washed;

a washing compartment door by which the loading opening is closeable in a fluid-tight manner; and a camera unit configured to visually sense the washing compartment, wherein the camera unit is integrated into a dispenser provided by the washing compartment door, and wherein the camera unit has a cover configured to close a camera opening in a fluid-tight manner.

15. A dishwasher, comprising:

a washing container comprising a washing compartment and a loading opening for loading items to be washed;

a washing compartment door by which the loading opening is closeable in a fluid-tight manner;

a camera unit configured to visually sense the washing compartment; and a closure element which is transferrable between a closed position covering a camera opening into a use position exposing the camera opening, wherein the camera unit is integrated into a dispenser provided by the washing compartment door.

16. The dishwasher of claim 15, wherein the closure element comprises a flap arranged displaceably on the dispenser.

17. The dishwasher of claim 15, wherein the closure element comprises a flap provided by the dispenser for selectively closing a dispensing chamber provided by the dispenser or interacting with such a flap.

18. The dishwasher of claim 15, further comprising:

transferring means configured to cause the closure element to be transferred between the closed position and the use position depending on a position of the washing compartment door.

19. The dishwasher of claim 15, wherein the closure element is in the use position when the washing compartment door is closed, and/or wherein the closure element is in the closed position when the washing compartment door is open.

* * * * *